United States Patent [19]

Johnson et al.

[11] 3,981,118

[45] Sept. 21, 1976

[54] CLAMPING INSERT

[75] Inventors: Ernest D. Johnson, Tallmadge; Hugh W. Wright, Stow, both of Ohio

[73] Assignee: The Goodyear Tire & Rubber Company, Akron, Ohio

[22] Filed: Oct. 17, 1974

[21] Appl. No.: 515,515

[52] U.S. Cl. ..... 52/716; 52/393; 52/397; 49/441

[51] Int. Cl.[2] ..... E04C 2/33; E04F 19/02

[58] Field of Search ..... 52/716, 717, 400, 397, 52/393; 308/3.6, 3.9; 49/441

[56] References Cited

UNITED STATES PATENTS

| | | | |
|---|---|---|---|
| 3,018,525 | 1/1962 | Deisenroth | 49/441 |
| 3,258,876 | 7/1966 | Deisenroth et al. | 49/441 |
| 3,286,389 | 11/1966 | Draplin et al. | 49/441 |
| 3,363,390 | 1/1968 | Crane | 52/716 |
| 3,455,080 | 7/1969 | Meadows | 52/716 |
| 3,789,564 | 2/1974 | Kessler | 52/400 |

FOREIGN PATENTS OR APPLICATIONS

| | | | |
|---|---|---|---|
| 1,102,045 | 2/1968 | United Kingdom | 52/716 |

*Primary Examiner*—Price C. Faw, Jr.
*Assistant Examiner*—Robert Farber
*Attorney, Agent, or Firm*—F. W. Brunner; R. P. Yaist; Frederick K. Lacher

[57] ABSTRACT

A clamping insert for disposition in a groove of a grooved member and around the edge of a plate member for locking the grooved member on the plate member. The clamping insert is an elongated body of elastomeric material having a central portion and side portions with a rib on each side portion for gripping engagement with the sides of the plate.

4 Claims, 4 Drawing Figures

CLAMPING INSERT

This invention relates generally, as indicated, to a resilient clamping insert for clamping and locking a trim member having a groove or slot to the edge of a plate or panel inserted into the slot.

Heretofore, apparatus for clamping metal trim or other grooved members to panels of glass or other material has included screw and lever or screw and wedge mechanisms. These mechanisms have increased the cost of the panel and trim assembly and have also established dimensional limitations because of the space required for these clamping devices. It has also been found that a plain resilient gasket disposed around the edge of a panel has not provided sufficient clamping and locking forces to hold a panel and trim assembly together.

With the foregoing in mind, it is a principal object of this invention to provide a compact clamping insert which will provide the necessary friction forces to hold the panel and trim assembly together.

Another object is to provide for ribs on the faces of the clamping insert which are compressible into frictional locking engagement with the panel.

Still another object of the invention is to provide locking flanges on the outside of the clamping insert for locking engagement with slots in a groove of a trim member.

A still further object of this invention is to provide ribs on the clamping insert which are tilted to provide increased frictional forces resisting removal of the panel from the trim member.

These and other objects of the present invention may be achieved by a clamping insert construction in which an elastomeric, compressible extrusion has locking flanges on the outside which cooperate with slots in the enveloping channel of the trim member and toggle leg ribs on the inside which exert a normal force against the glass panel.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

Figure 1:
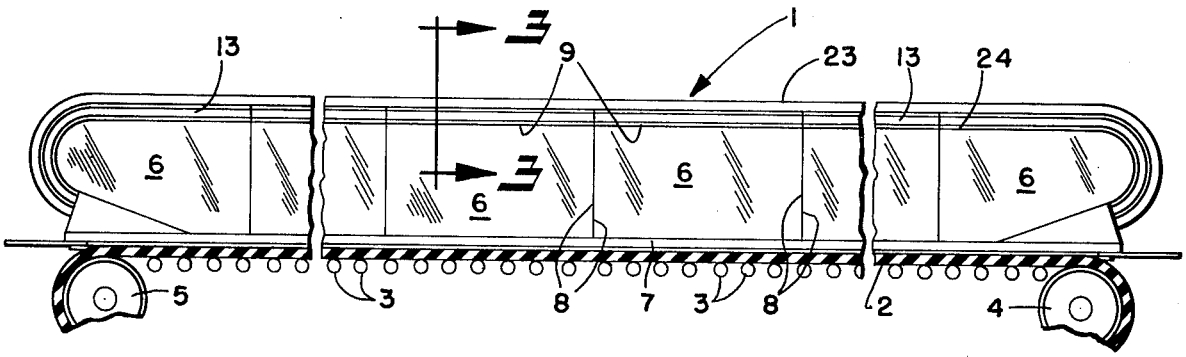
FIG. 1 is a schematic elevational view of a passenger conveyor system incorporating a preferred form of clamping insert in a balustrade panel and trim assembly embodying the present invention.

A balustrade structure 1 embodying the invention is shown in FIG. 1 as applied to a typical passenger conveying system in which a double balustrade structure extends along the sides of moving belt 2 supported on rollers 3 and guided around the ends by sheaves 4 and 5.

The balustrade structure 1 includes plate members such as glass panels 6 which are supported at the bottom edge by a supporting base member 7 with the side edges 8 of the panels in abutting relationship. Top edge 9 of each of the glass panels 6 extends into a groove 12 of a grooved member such as channel 13 shown more clearly in FIGS. 2 and 3. The channel 13 may be an extrusion of aluminum or other suitable material. A handrail guide 14 of sheet metal or other suitable material is clamped to the channel 13 by bolts 15 having heads disposed in a recess 16 in the upper part of the channel at intervals along the length of the balustrade 1. Threaded shanks 17 of the bolts 15 extend upwardly through an opening 18 of reduced width in channel 13 and through holes 19 in the handrail guide for clamping engagement by threading of nuts 22 over the shanks of the bolts. A handrail 23 is disposed over the handrail guide 14 and may be of a flexible reinforced material having a C-shaped cross section for sliding movement on the handrail guide.

Figure 2:
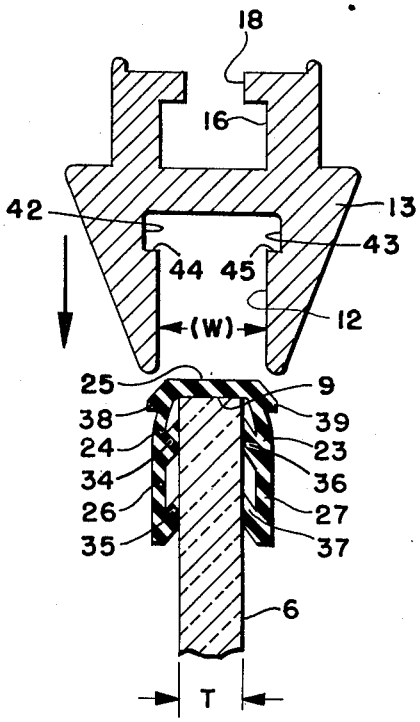
FIG. 2 is an enlarged fragmentary sectional view indicating the relative movement of the grooved trim member over the clamping insert and glass panel during assembly.
Figure 3:
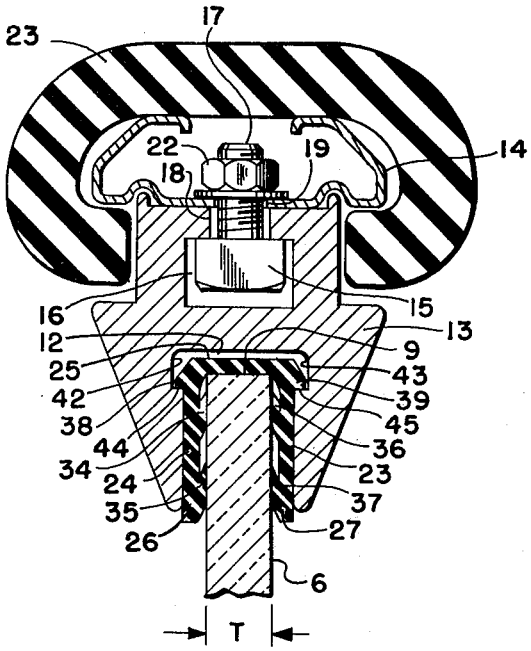
FIG. 3 is an enlarged fragmentary sectional view taken along the plane of line 3—3 of FIG. 1.
Figure 4:
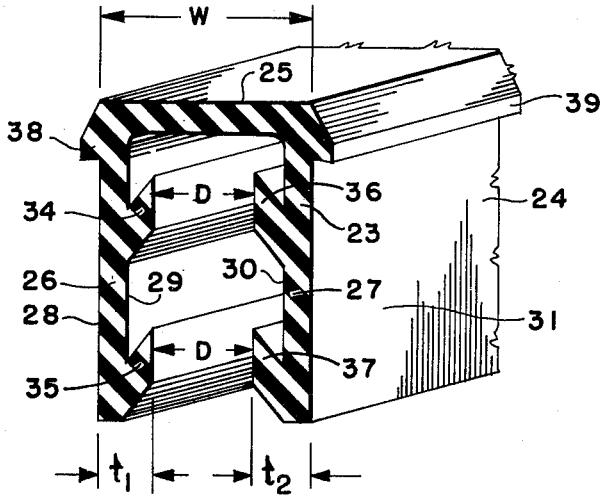
FIG. 4 is an enlarged fragmentary sectional view in perspective of the clamping insert showing the insert in the condition prior to installation.

As shown more clearly in FIGS. 2, 3 and 4, a clamping insert 24, which may be a molded or extruded elongated body of elastomeric material such as rubber, is mounted between the panel 6 and the channel 13 in groove 12. The clamping insert 24 is shown in the molded or extruded condition in FIG. 4 and has a central portion 25 and two side portions 26 and 27 extending in a substantially parallel relationship away from the central portion in a generally U-shape. Each of the side portions 26 and 27 have opposing generally parallel faces 28, 29, 30 and 31. Ribs 34 and 35 project inwardly from the face 29 of side portion 26 at spaced-apart positions and may be tilted towards the central portion 25 to provide a greater clamping action against the sides of panels 6. On the other side portion 27, ribs 36 and 37 project from face 30 and these ribs may also be tilted toward the central portion 25.

Locking flanges 38 and 39 project outwardly from the faces 28 and 31 of side portions 26 and 27 at a position close to the central portion 25. The edges of the locking flanges 38 and 39 may be tapered towards the central portion 25 so that the width W of the clamping insert 24 at the central portion is approximately the same as the width ($w$) of the groove 12 in channel 13 for ease of assembly.

The thickness T of the panels 6 is less than the width ($w$) of the groove 12 of channel 13 to provide a space therebetween for the side portions 26 and 27 of clamping insert 24. The sum of the thickness of the side portion 26 including the ribs 34 and 35 ($t1$), plus the thickness of the side portion 27 including ribs 36 and 37 ($t2$), is greater than the difference between the width ($w$) of the groove 12 minus the thickness T of panels 6. As a result, the side portions 26 and 27 and the ribs 34, 35, 36 and 37 are compressed between the channel 13 and panels 6 as shown in FIG. 3. The ribs 34, 35, 36 and 37 are further tilted towards the central portion 25 and act as toggle arms resisting removal of the panels 6 from the channel 13.

The force resisting compression is a function of the durometer of the elastomeric material from which the clamping insert 24 is made. Different thicknesses T of the panels 6 may be used with the same size clamping insert 24 and channel 13 by changing the durometer of the material of the clamping insert. The distance D between the ribs 35 and 37 and the ribs 34 and 36, as shown in FIG. 4, is preferably less than the thickness T of the panels 6. With a panel thickness T substantially less than the width ($w$) of groove 12 of channel 13, an elastomeric material of a higher durometer would be used than in an installation where the thickness T of the panels 6 is greater to provide a force resisting compression of the ribs 34 through 37 and the side portions 26 and 27 which is proportionally greater.

The clamping insert 24 is preferably of an elastomeric material such as neoprene of 40 durometer capable of substantial elongation on the order of 25 percent. This elongation also makes possible using one size insert without a change in durometer for different thicknesses T of panels 6. Where the difference between the groove width ($w$) and the thickness T of the panels 6 is reduced because of greater panel thickness due to tolerance variations or balustrade specifications, the thickness ($t1$) of the ribs 34, 35 and side portion 26 as well as the thickness ($t2$) of the ribs 36, 37 and side portion 27 can be reduced by stretching and elongating the clamping insert 24.

The groove 12 of channel 13 has slots 42 and 43 for engagement with abutting portions such as the locking flanges 38 and 39 of the side portions 26 and 27 to further prevent movement of the clamping insert 24 and clamped panels 6 out of the channel 13.

In assembling the channel 13, clamping insert 24 and panels 6, the side portions 26 and 27 are slipped over the top edge 9 of the panels 6 into the position shown in FIG. 2. The channel 13 is then forced over the clamping insert 24 and the clamping insert urged into the groove 12 until the locking flanges 38 and 39 resiliently move into the slots 42 and 43 of the channel. If desired, the insert 24 may be stretched and elongated prior to forcing the channel 13 over the panels 6 to accommodate panels of greater thickness T and reduce the force necessary to urge the insert into the groove 12 during assembly. Projecting edges 44 and 45 of the slots 42 and 43 engage the flanges 38 and 39 of the clamping insert 24 to lock the clamping insert in position.

In the assembly of the channel 13 over the clamping insert 24, a suitable lubricant may be applied to the tapered edges of the locking flanges 38 and 39 and also to the faces 28 and 31 of the side portions 26 and 27. This lubricant will facilitate sliding movement of the groove 12 over the surfaces but will not adversely affect the frictional engagement of the ribs 34 through 37 against the panels 6. After the channel 13 has been mounted on the panels 6, the handrail guide 14 may be clamped to the channel by bolts 15 and nuts 22 and the handrail 23 slipped over the handrail guide.

Although the clamping insert of this invention has been described and illustrated as applied to a balustrade for a passenger conveyor, it is understood that the construction of this invention may be applicable also to other constructions in which a grooved member is mounted over the edge of a glass panel or panel of other material. Also while certain representative embodiments and details have been shown for the purpose of illustrating the invention, it will be apparent to those skilled in the art that various changes and modifications may be made therein without departing from the spirit or scope of the invention.

We, therefore, particularly point and claim as our invention:

1. In combination, a plate member having a supporting edge, a grooved member having a groove of greater width than the thickness of said plate member for receiving said edge and a clamping insert for gripping the sides of said plate member at said supporting edge and for insertion with said supporting edge into said groove, said insert comprising an elongated body of elastomeric material having a central portion and side portions, said side portions having locking flanges extending outwardly from the outer faces and ribs extending inwardly from the opposing inner faces for engagement with the sides of said plate member, the thickness of said side portions and said ribs being greater than the difference between the width of said groove and the thickness of said plate whereby said ribs are compressed into gripping engagement with the sides of said plate, said groove having an end and sides with slots in the sides of said groove for engaging said locking flanges of said side portions of said clamping insert in locking engagement in said slots and said elastomeric material being stretchable whereby said clamping insert may be elongated to reduce the thickness of said side portions including said ribs to compensate for dimensional variations of the plate member, grooved member and clamping insert.

2. The combination of claim 1 wherein said locking flanges are tapered inwardly toward said central portion so that the entering width of said clamping insert is approximately the same as the width of said groove for ease of movement of said grooved member over said insert and said plate member.

3. A clamping insert according to claim 1 wherein each of said side portions has two ribs on each for gripping the sides of said plate member.

4. A clamping insert according to claim 1 wherein said body of elastomeric material is formed with said ribs on one of said side portions and on the other of said side portions being spaced apart a distance less than the thickness of said plate member.

* * * * *